US008807693B2

(12) United States Patent
Nakajima

(10) Patent No.: US 8,807,693 B2
(45) Date of Patent: Aug. 19, 2014

(54) IMAGE FORMING APPARATUS

(71) Applicant: Seiko Epson Corporation, Tokyo (JP)

(72) Inventor: Mikito Nakajima, Ina (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/668,948

(22) Filed: Nov. 5, 2012

(65) Prior Publication Data

US 2013/0120490 A1 May 16, 2013

(30) Foreign Application Priority Data

Nov. 16, 2011 (JP) ..... 2011-250384

(51) Int. Cl.
*B41J 29/393* (2006.01)
*B41J 2/01* (2006.01)
*B41J 11/00* (2006.01)

(52) U.S. Cl.
CPC ..... *B41J 11/002* (2013.01)
USPC ..... 347/19; 347/102

(58) Field of Classification Search
CPC ..... B41J 11/002
USPC ..... 347/19, 102
See application file for complete search history.

(56) References Cited

U.S. PATENT DOCUMENTS 7,055,945 B2 6/2006 Yoneyama et al.
2004/0119802 A1 * 6/2004 Yoneyama et al. ..... 347/102

FOREIGN PATENT DOCUMENTS

| | | |
|---|---|---|
| EP | 2353878 | 8/2011 |
| JP | 2000-158793 | 6/2000 |
| JP | 3855724 B2 | 9/2006 |
| JP | 2007-203592 | 8/2007 |
| JP | 2009-051094 | 3/2009 |
| WO | 2006-043269 | 4/2006 |

OTHER PUBLICATIONS

European Search Report dated Feb. 22, 2013 for European Patent Application No. 12192545.7.

* cited by examiner

*Primary Examiner* — Stephen Meier
*Assistant Examiner* — Alexander D Shenderov
(74) *Attorney, Agent, or Firm* — Workman Nydegger

(57) ABSTRACT

An image forming apparatus which includes an ejecting unit which ejects liquid cured by being irradiated with light onto a medium for printing, an irradiation unit which irradiates the liquid which has landed onto the medium for printing with the light, and an image quality inspection unit which inspects an image quality of an image which is formed on the medium for printing, in which, when the image quality inspection unit detects abnormal formation of the image, an intensity of the light of the irradiation unit is controlled.

7 Claims, 9 Drawing Sheets

IMAGE FORMING APPARATUS

BACKGROUND

1. Technical Field

The present invention relates to an image forming apparatus.

2. Related Art

As an image forming apparatus which performs printing using a liquid (for example, UV ink) which is cured by irradiation of light (for example, ultraviolet light (UV)), for example, an ink jet printer which includes an ejecting unit (for example, head) which ejects UV ink, and an irradiation unit which radiates UV has been known. In such a printer, UV ink is ejected from a head onto a medium for printing, and then an irradiation unit irradiates dots which are formed on the medium for printing with UV. In this manner, it is possible to perform good printing even for a medium for printing on which ink is not easily absorbed, since the dots are fixed onto the medium for printing by being cured (refer to JP-A-2000-158793).

In the above described printer, when an abnormality occurs when performing printing, it is preferable to control the intensity of UV (for example, stop UV irradiation) from the irradiation unit in order to prevent deterioration, ignition, or the like of the medium for printing due to excessive irradiation of UV. However, when detection of an abnormality is performed in the previous stage of the head (for example, abnormality in transport system), and the UV irradiation is stopped according to the result, there is concern that a lot of images which are not irradiated with the UV (uncured state) may be formed, regardless of being normally printed. That is, there is a concern that waste paper (also referred to as torn paper) may increase.

SUMMARY

An advantage of some aspects of the invention is to provide an image forming apparatus in which waste paper is reduced.

According to an aspect of the invention, there is provided an image forming apparatus which includes an ejecting unit which ejects liquid which is cured by being irradiated with light onto a medium for printing, an irradiation unit which irradiates the liquid which has landed on the medium for printing with the light, and an image quality inspection unit which inspects the image quality of an image which is formed on the medium for printing, in which, when the image quality inspection unit detects abnormal formation of the image, an intensity of the light of the irradiation unit is controlled.

Other features of the invention will be clarified by descriptions of the present application and accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
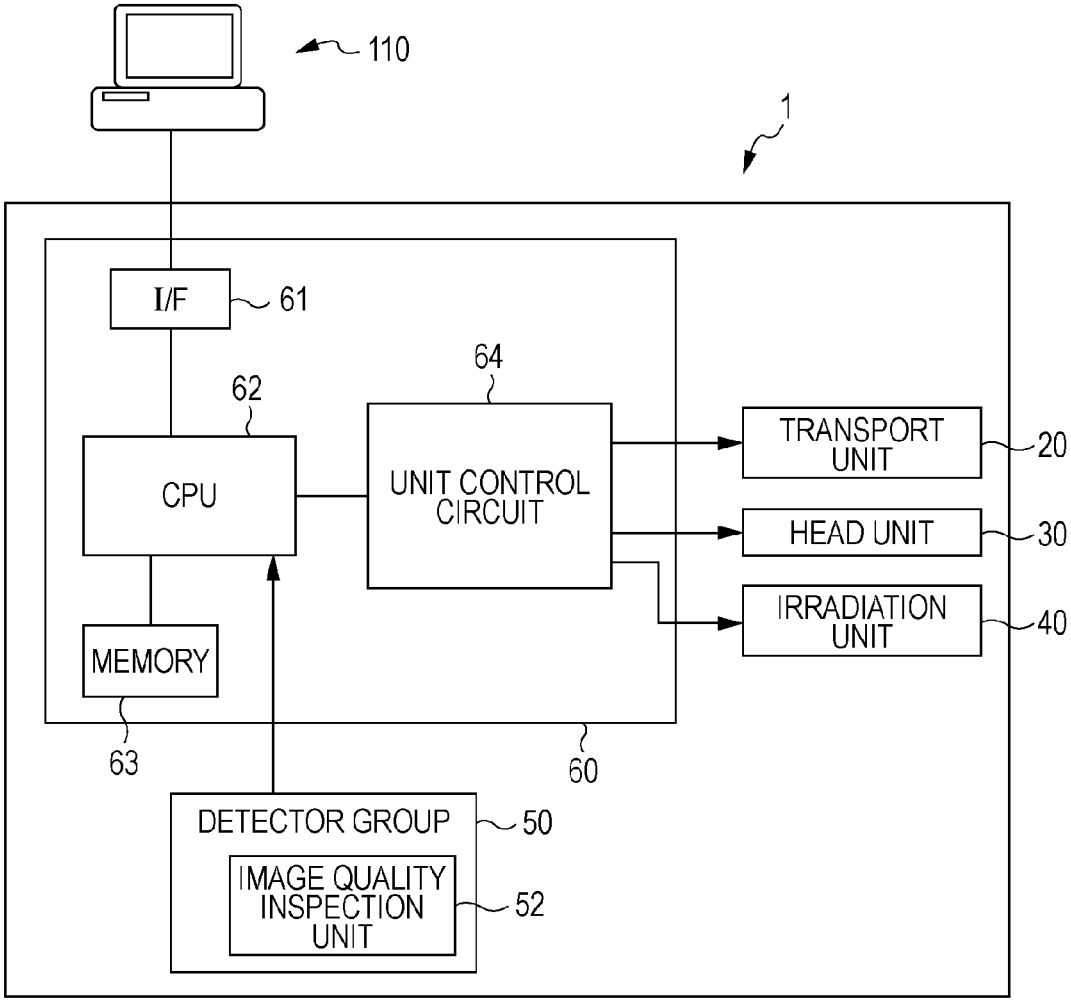
FIG. 1 is a block diagram which illustrates the overall configuration of a printer.

According to descriptions of the specification and accompanying drawings, at least the following matters will be clarified.

According to an aspect of the invention, there is provided an image forming apparatus which includes an ejecting unit which ejects liquid cured by being irradiated with light onto a medium for printing, an irradiation unit which irradiates the liquid which has landed onto the medium for printing with the light, and an image quality inspection unit which inspects image quality of an image which is formed on the medium for printing, in which, when the image quality inspection unit detects abnormal formation of the image, an intensity of the light of the irradiation unit is controlled.

According to the image forming apparatus, since the light intensity of the irradiation unit is controlled based on an inspection result after forming an image, it is possible to reduce the amount of images which remain uncured regardless of being normally printed. Accordingly, it is possible to reduce waste paper.

In the image forming apparatus, the ejecting unit and the irradiation unit are provided on a transport path of the medium for printing, and the image quality inspection unit may be arranged on the downstream side of the ejecting unit in the transport direction of the medium for printing, and on the upstream side of the irradiation unit in the transport direction.

According to the image forming apparatus, it is possible to control the light intensity as early as possible, and to reduce the waste paper.

In the image forming apparatus, the ejecting unit and the irradiation unit are provided on the transport path of the medium for printing, and the image quality inspection unit may be arranged on the downstream side of the irradiation unit in the transport direction.

According to the image forming apparatus, it is possible to detect the abnormality of an image including the irradiation unit.

In the image forming apparatus, the light intensity of the light of the irradiation unit may be controlled when the image quality inspection unit detects the formation of abnormality of the image.

According to the image forming apparatus, it is possible to prevent deterioration, ignition, or the like of the medium for printing due to excessive irradiation of light, for example, in a case of abnormality in the transport system.

In the image forming apparatus, the light intensity of the light of the irradiation unit may be controlled after a predetermined time has passed after detecting the abnormal formation of the image by the image quality inspection unit.

According to the image forming apparatus, it is possible to further reduce the waste paper.

In the image forming apparatus, the predetermined time may be set based on transport speed and a transport path of the medium for printing.

According to the image forming apparatus, it is possible to control a light intensity at an accurate timing.

In the image forming apparatus, the intensity of the light of the irradiation unit may be controlled after the image has passed through the irradiation unit after detecting the abnormal formation of the image by the image quality inspection unit.

According to the image forming apparatus, it is possible to further reduce the waste paper.

In the image forming apparatus, the intensity of the light of the irradiation unit may be weakened when the image quality inspection unit detects the abnormal formation of the image.

According to the image forming apparatus, it is possible to prevent the deterioration, ignition, or the like of the medium for printing due to the excessive irradiation.

In the image forming apparatus, the irradiation of the light from the irradiation unit may be stopped when the image quality inspection unit detects the abnormal formation of the image.

According to the image forming apparatus, it is possible to reliably prevent the deterioration, ignition, or the like of the medium for printing due to the excessive irradiation.

First Embodiment

Configuration of Printer

Figure 2:
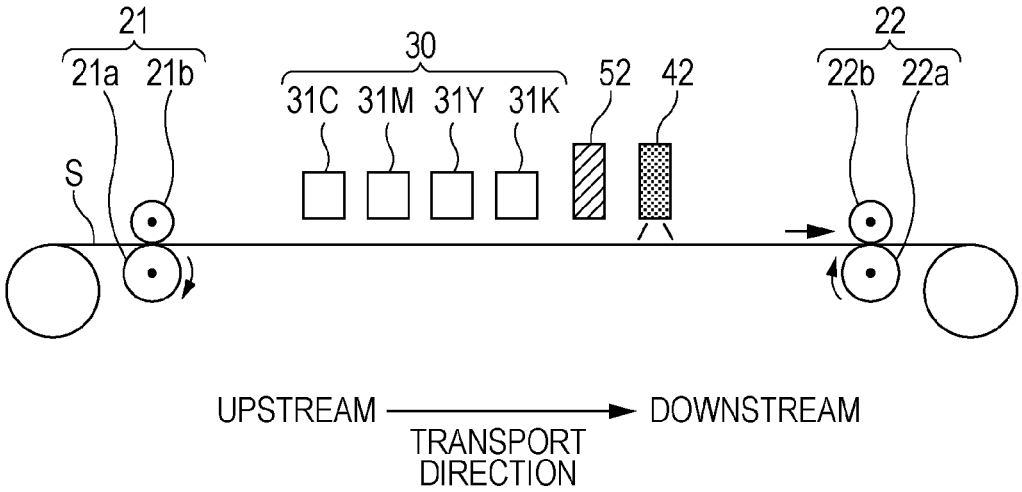
FIG. 2 is a schematic diagram which illustrates the periphery of a printing area.

FIG. 1 is a block diagram of the overall configuration of a printer 1. In addition, FIG. 2 is a schematic diagram which illustrates the periphery of a printing area.

The printer 1 is a printing device which prints an image on a medium for printing such as paper, cloth, a film or the like, and is communicably connected to a computer 110 as an external device. In addition, according to the embodiment, rolled paper (hereinafter, referred to as sheet S) is used as the medium for printing.

A printer driver is installed on the computer 110. The printer driver is a program which displays a user interface (not shown) in a display unit, and converts image data which is output from an application program to print data. The printer driver is recorded on a recording medium (computer-readable recording medium) such as a CD-ROM. In addition, the printer driver can also be downloaded to the computer 110 through the Internet. In addition, the program is configured by code which executes various functions.

In addition, the computer 110 outputs print data corresponding to a printed image to the printer 1 in order to cause the printer 1 to print an image.

The printer 1 according to the embodiment is a device which prints an image onto a medium for printing by ejecting UV curable ink (hereinafter, also referred to as UV ink) which is cured by irradiation of ultraviolet light (on kind of light, and hereinafter, also referred to as UV), as an example of a liquid. The UV ink is ink which includes a UV curable resin, and is cured by a photo-polymerization reaction which is caused in the UV curable resin when irradiated with UV. In this manner, when using the UV ink, it is possible to form an image without depending on the ink absorbency of the medium for printing, since it is possible to cure the UV ink instantly by radiating the UV.

The printer 1 according to the embodiment includes a transport unit 20, a head unit 30, an irradiation unit 40, a detector group 50, and a controller 60. The printer 1 which receives print data from the computer 110 as an external device controls each unit (transport unit 20, head unit 30, and irradiation unit 40) using the controller 60, and prints an image on a medium for printing (sheet S) according to the print data. The controller 60 controls each unit based on the print data which is received from the computer 110. A situation in the printer 1 is monitored by the detector group 50, and the detector group 50 outputs a detection result to the controller 60. The controller 60 controls each unit based on the detection result which is output from the detector group 50.

The transport unit 20 is a unit which transports the sheet S in the transport direction. The transport unit 20 includes a transport motor (not shown), a pair of upstream side transport rollers 21, and a pair of downstream side transport rollers 22. In addition, the pair of upstream side transport rollers 21 includes a transport roller 21*a* and a driven roller 21*b*. The pair of downstream side transport rollers 22 includes a transport roller 22*a* and a driven roller 22*b*.

When the transport motor (not shown) is rotated, the transport roller 21*a* and the transport roller 22*a* rotate (rotate in arrow direction in figure). In this manner, each driven roller rotates, and the sheet S is transported in the transport direction.

The head unit 30 is a unit which ejects UV ink onto the sheet S. The head unit 30 forms dots on the sheet S by ejecting ink from each head with respect to the sheet S in the middle of being transported (that is, head unit prints image on sheet S). According to the embodiment, as the UV ink, CMYK color inks for printing an image are used. As illustrated in FIG. 2, in the printer 1, a cyan ink head 31C which ejects cyan UV ink, a magenta ink head 31M which ejects magenta UV ink, a yellow ink head 31Y which ejects yellow UV ink, and a black ink head 31K which ejects black UV ink are provided in order from the upstream side in the transport direction as the head unit 30. In addition, each head of the head unit 30 corresponds to an ejecting unit.

The printer 1 according to the embodiment is a line printer, the length of each head of the head unit 30 in the sheet width direction (direction intersecting transport direction) is set to be the same as, or longer than the maximum width of the sheet S as a printing target. In addition, each head of the head unit 30 is able to form dots by the sheet width at once.

The irradiation unit 40 is a unit which radiates the UV toward the sheet S. The dots which are formed on the sheet S are cured by being irradiated with the UV from the irradiation unit 40. The irradiation unit 40 according to the embodiment includes an irradiation portion 42.

The irradiation portion 42 is provided on the downstream side of each head of the head unit 30 in the transport direction. In addition, the irradiation portion 42 irradiates the dots which are formed on the sheet S with the UV using each head. In addition, the length of the irradiation portion 42 in the sheet width direction corresponds to the head, and is the same as, or longer than the maximum width of the sheet S as the printing target.

In addition, the irradiation portion 42 according to the embodiment includes a light emitting diode (LED: Light Emitting Diode) as a light source of the UV irradiation. When the light source is the LED, it is possible to easily change the light intensity by controlling a magnitude of an input current. Here, the light intensity is a physical quantity denoting how long brightness of light which is emitted in a certain direction from the light source is continued, and an intensity which is denoted by integral calculus of light flux. In addition, the input current to the LED is controlled by the controller 60.

The detector group 50 includes a rotary encoder (not shown) or the like. The rotary encoder detects a rotation amount of an upstream side transport roller 23A, or a downstream side transport roller 23B. It is possible to detect a transport amount of the sheet S based on a detection result of the rotary encoder. In addition, the detector group 50 according to the embodiment includes an image quality inspection unit 52 which inspects abnormal formation of an image on the sheet S due to the head unit 30, or the transport unit 20. In addition, the image quality inspection unit 52 will be described later in detail.

The controller 60 is a control unit which controls the printer. The controller 60 includes an interface unit 61, a CPU 62, a memory 63, and a unit control circuit 64. The interface unit 61 performs transmitting and receiving of data between the computer 110 as the external device and the printer 1. The CPU 62 is an arithmetic processing unit which performs an overall control of the printer. The memory 63 is a unit which secures an area for storing a program of the CPU 62, a work area, or the like, and includes a storage element such as a RAM EEPROM, or the like. The CPU 62 controls each unit through the unit control circuit 64 according to the program which is stored in the memory 63.

Regarding Head

Figure 3:
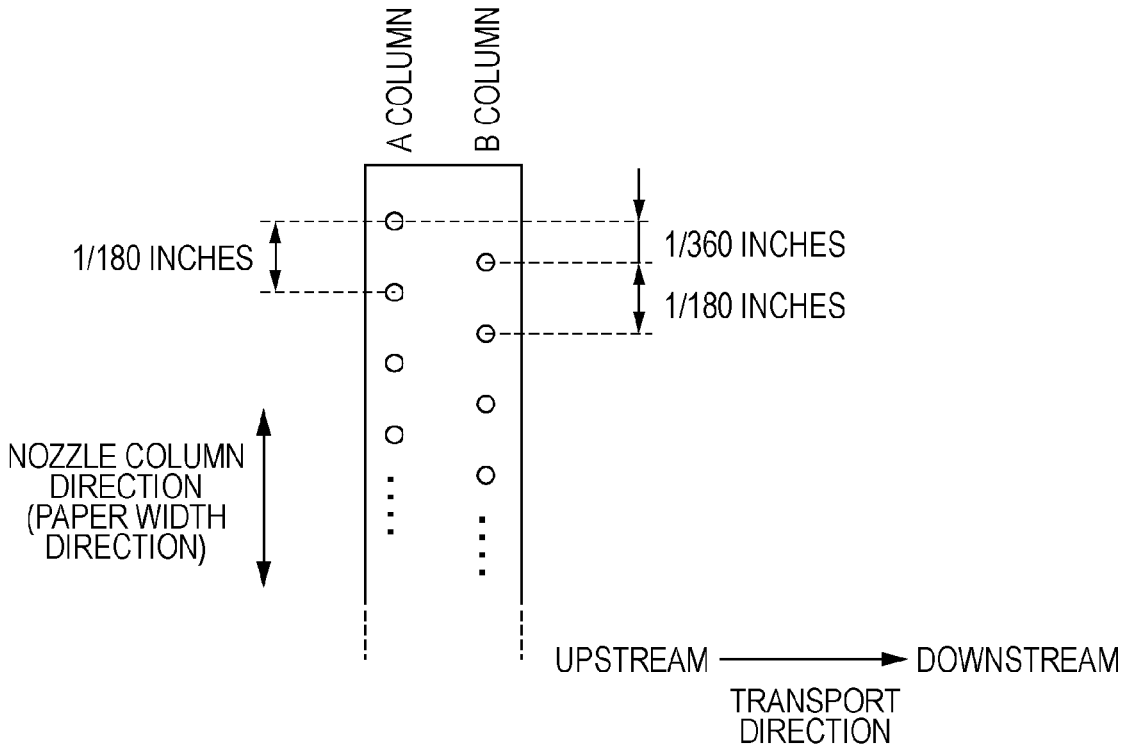
FIG. 3 is an explanatory diagram which illustrates an arrangement of nozzle of each head.

FIG. 3 is an explanatory diagram which illustrates an example of a nozzle arrangement of each head. In addition, the configurations of each head of the cyan ink head 31C, the magenta ink head 31M, the yellow ink head 31Y, and the black ink head 31K are the same as each other. Accordingly, one head among them will be described as an example. The head according to the embodiment includes two nozzle columns of "A column" and "B column", as shown in the figure.

Nozzles in each column are aligned with an interval of 1/180 inches (nozzle pitch) along the direction intersecting the transport direction (nozzle column direction). In addition, positions of nozzles in the A column in the nozzle column direction, and positions of nozzles in the B column in the nozzle column direction are deviated by a half nozzle pitch (1/360 inches). That is, a plurality of nozzles are aligned at a constant interval (360 dpi) over the length of the sheet width in the nozzle column direction in the base of the head unit 30. In this manner, dots of each color are able to be formed with a resolution of 1/360 inches. In addition, a configuration of the head is not limited to this. For example, the plurality of nozzles may be linearly aligned (in one column). In addition, the plurality of nozzle columns corresponding to the ink colors (for example, CMYK) which are used may be formed in one head.

Regarding UV Ink

The UV ink contains a photo-initiator, monomer, oligomer, a pigment, or the like. In addition, as a reaction type of the UV ink, there are a radical polymerization method, and a cationic polymerization method. According to the embodiment, the radical polymerization method is adopted, however, the cationic polymerization method may be adopted.

In the radical polymerization method, various acrylic monomers, or the oligomer are used as curing ingredients. The monomer is a molecule which can be a constituent element of a basic structure of polymer, and there are a monofunctional monomer, a polyfunctional monomer (bifunctional monomer), or the like. As the monofunctional monomer, isobornyl acrylate, phenoxyethyl acrylate, and the like are used, and as the polyfunctional monomer, trimethylolpropane triscrylate, polyethylene glycol diacrylate, and the like are used. As the olygomer, urethane acrylate or the like is used.

In addition, as a color agent of the ink, a dye, or a pigment is used. As the pigment, it is possible to use an inorganic pigment, or an organic pigment without being particularly limited. As the inorganic pigment, there are titanium oxide, and iron oxide. As the organic pigment, it is possible to use azo pigments (azo lake pigments, insoluble azo pigments, or the like), polycyclic pigments, dye chelate, a nitro color, or the like. In addition, clear ink does not include a color agent.

As the photo-initiator, various aromatic ketones such as benzophenone, phenylphosphine oxide are used. In the radical polymerization method, when light is irradiated to ink including these photo-initiators, the photo-initiators absorb light with a specific wavelength, and produce radical. In addition, a polymerization reaction (polymerization) advances (curing advances) when the radical attacks the monomer.

Regarding Process of Printer Driver

Figure 4:
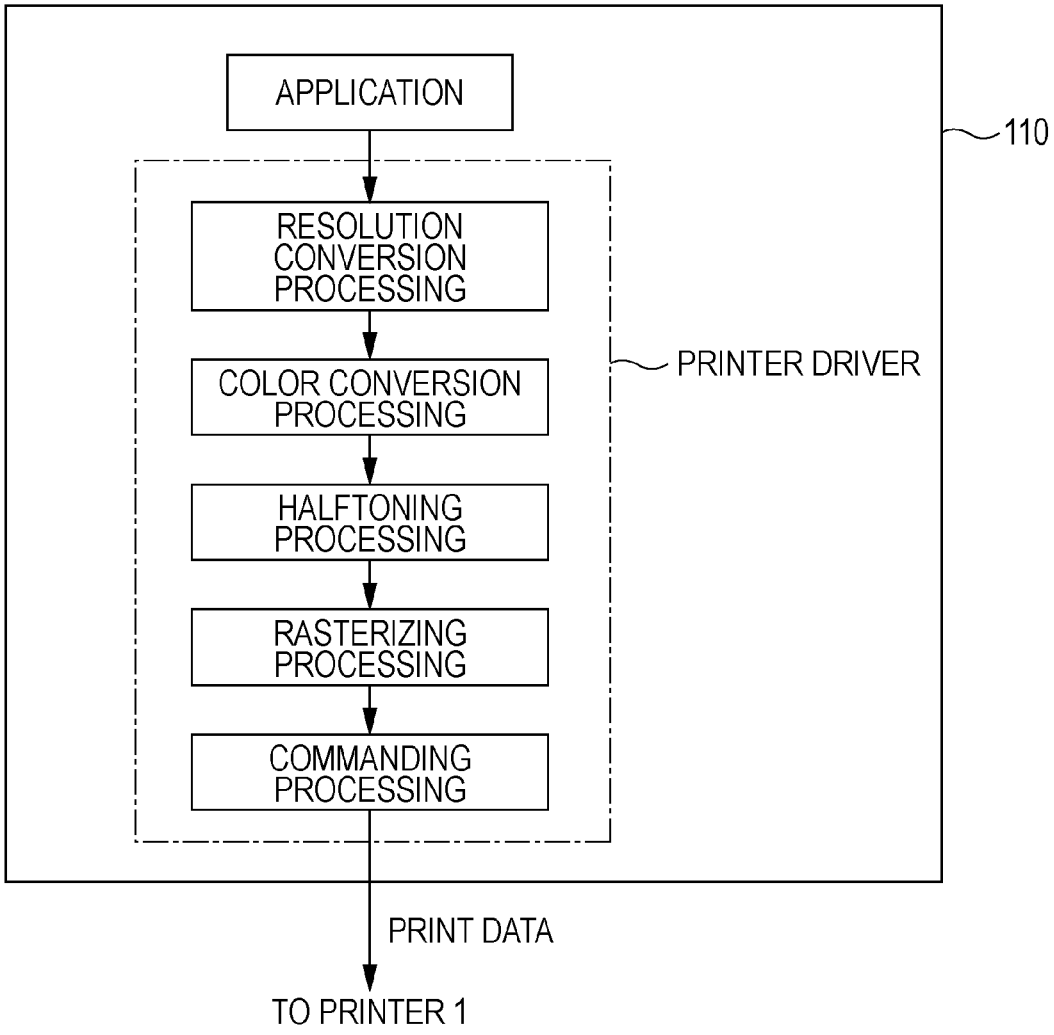
FIG. 4 is a flowchart which illustrates a process which is performed by a printer driver.

FIG. 4 is a flowchart which illustrates processing which is performed by the printer driver when printing is performed by the printer 1.

The printer driver receives image data from the application program, converts the image data to print data having a format which can be interpreted by the printer 1, and outputs the print data to the printer. The printer driver performs processes of resolution conversion, color conversion, halftoning, rasterizing, command addition, or the like, when converting the image data from the application program to the print data. Hereinafter, various processes which are performed by the printer driver will be described.

The resolution conversion process is a process in which the image data which is output from the application program (text data, image data, or the like) is converted to a resolution (print resolution) at the time of being printed on paper. For example, when the printing resolution is designated to 720×720 dpi, image data of vector format which is received from the application program is converted to image data of bitmap format having a resolution of 720×720 dpi. In addition, each pixel data of the image data which is performed with the resolution conversion process is RGB data having multi gray scale (for example, 256 gray scales) which is expressed using an RGB color space.

The color conversion process is a process in which the RGB data is converted to data in a color space corresponding to ink color which forms an image. For example, when an image is printed using ink of CMYK, the RGB data is converted to a color space of CMYK. The color conversion process in this case is performed based on a table (color conversion lookup table LUT) in which gray scale levels of the RGB data and the gray scale levels of the CMYK data are correlated with each other. In addition, in this case, the pixel data after the color conversion process is the CMYK data of 256 gray scales which is expressed in a CMYK color space.

The halftoning process is a process in which data with a high gray scale level is converted to data with a gray scale level which can be formed by the printer. For example, data denoting 256 gray scales is converted to 1 bit data denoting 2 gray scales, or 2 bit data denoting 4 gray scales using the halftoning process. In the halftoning process, a dither method, γ correction, an error diffusion method, and the like, are used. The data performed with the halftoning process has the same resolution as that of the print resolution (for example, 720×720 dpi). In the image data performed with the halftoning process, 1 bit or 2 bit pixel data corresponds thereto in each pixel, and the pixel data is data which denotes the formation state of dots in each pixel (presence or absence of dot, and dot size).

The rasterizing process is a process in which pixel data which is aligned in a matrix shape is rearranged in order of data to be transmitted to the printer 1 in each pixel data. For example, the pixel data is rearranged according to a nozzle aligning order of each nozzle column.

The command addition process is a process in which command data according to a printing method is added to the data which is performed with the rasterizing process. As the command data, there is, for example, transport data which denotes the transport speed of the sheet S, or the like.

The print data which is generated by being performing with these processes is transmitted to the printer 1 using the printer driver.

Regarding Printing Operation

The controller 60 transports a sheet S to the transport unit 20 along the transport direction at a constant speed when performing printing. In addition, the controller 60 forms dots on the sheet S by causing the head unit 30 to intermittently eject UV ink while transporting the sheet S. The dots (image) which are formed on the sheet S by the head unit 30 by being transported in the transport direction passes through the bottom of the irradiation portion 42. At this time, the controller 60 causes the irradiation portion 42 to radiate UV. The dots which are formed on the sheet S are cured by being irradiated with the UV from the irradiation portion 42.

Regarding Image Quality Inspection Unit 52

The printer 1 according to the first embodiment includes an image quality inspection unit 52 between the head unit 30 and the irradiation portion 42, as shown in FIG. 2.

The image quality inspection unit 52 includes a light emission unit which is not shown, and a photo sensor (for example, CCD) on the surface facing the sheet S. In addition, the image quality inspection unit 52 radiates light to the sheet S which is in the middle of being transported from the light emission unit, and detects reflected light thereof using the photo sensor. In this manner, the image quality inspection unit 52 reads out an image which is formed on the sheet S. In addition, the image quality inspection unit 52 is arranged in parallel to each head (nozzle column), and linearly reads out the image formed on the sheet S.

In addition, the image quality inspection unit 52 performs an inspection of an image quality of the image which is formed on the sheet S by comparing a result of reading of the image to the print data. That is, a presence of abnormal formation of an image on the sheet S is determined.

Regarding Abnormal Image

As abnormal formations of images which are inspected by the image quality inspection unit 52, there are abnormal formations of dots due to the head unit 30, and an abnormality of a transport system due to the transport unit 20.

As the abnormal formations of dots, for example, there is a case of clogging of nozzles which is caused when ink (liquid) is not ejected from the nozzles for a long time, or foreign matter such as paper dust are attached to the nozzles. When the nozzles are clogged in this manner, a failure in ejecting occurs. The "failure in ejecting" includes cases, for example, in which ink is not ejected from the nozzles at a right time for ejecting, or a predetermined amount of ink is not ejected. When the "failure in ejecting" occurs while performing printing, dot omission occurs, or the amount of ink ejected is reduced, accordingly the image is viewed faintly. Hereinafter, nozzles from which such a failure in ejecting occurs are also referred to as "defective nozzles".

Figure 5:
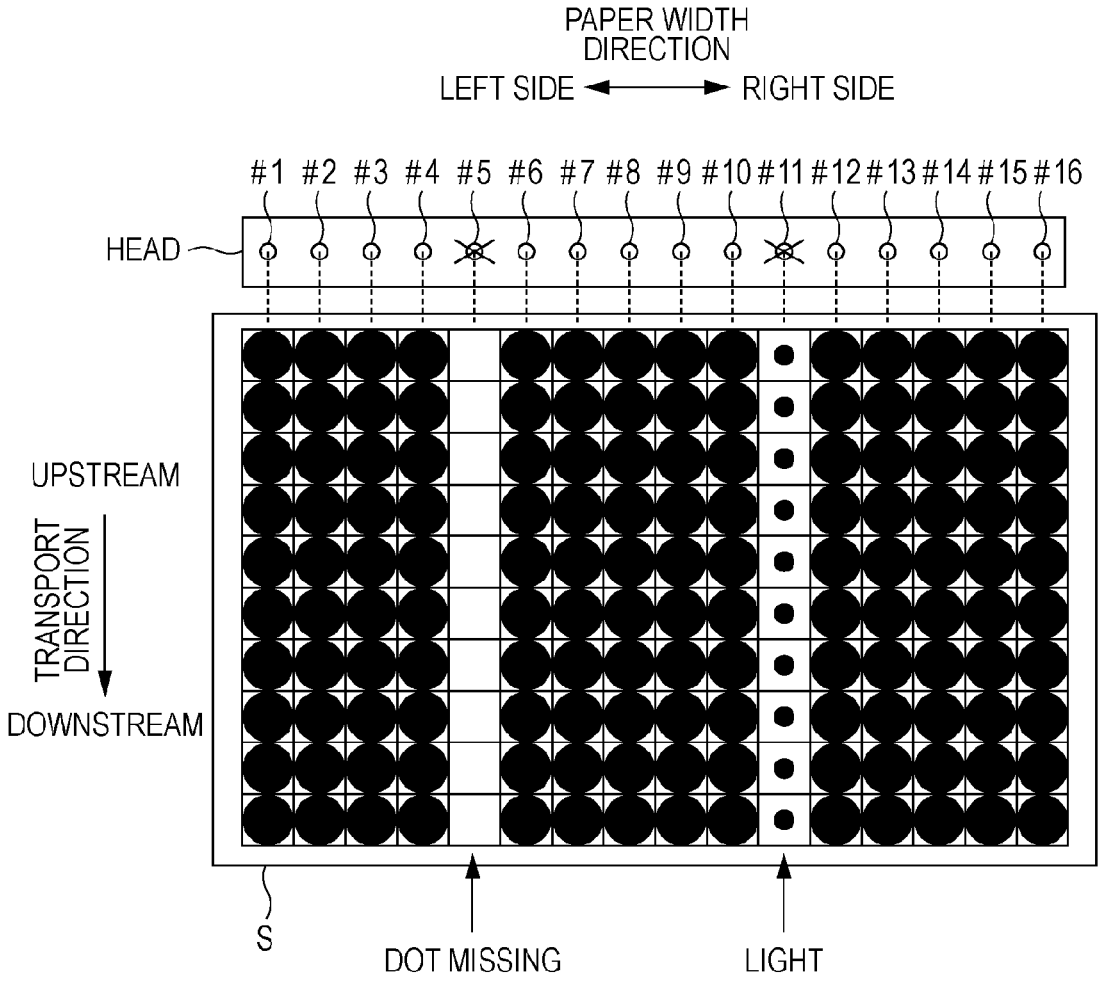
FIG. 5 is a diagram which illustrates a situation in which defective nozzles occur.

FIG. 5 is a diagram which illustrates a state in which the defective nozzle occurs. For descriptions, the number of nozzles of the head is reduced to be drawn, and the nozzles are numbered in ascending order from the left. In the figure, one square corresponds to a "pixel" (unit area which is virtually determined on sheet S), and dots having a predetermined size are formed all of the pixels. However, liquid is not ejected from the nozzle of number 5, and a small amount of liquid is ejected from the nozzle of number 11 compared to other nozzles. That is, the nozzles of number 5 and number 11 correspond to defective nozzles. In the printer 1 according to the embodiment, one nozzle (one nozzle for each color head) is allocated to the pixel column which is aligned in the transport direction (pixel column). That is, in the pixel column to which the defective nozzle is allocated, as shown in FIG. 5, dots are not formed all of the pixels, or dots having an inappropriate size are formed. As a result, a pixel column being allocated with the defective nozzle is expressed as stripes on a print image, and causes deterioration of an image quality (that is, abnormal formation of image).

In addition, as the abnormality of the transport system, there are an oblique motion (hereinafter, also referred to as skewing), paper jam, or the like. Skewing is a state in which the sheet S is transported in a state of being obliquely tilted to the transport direction. If skewing occurs, for example, when full printing is performed, there is a concern that an unprinted portion may occur (blank portion). In addition, ink is not landed onto an accurate position (pixel) of the sheet S. The paper jam is a state in which the sheet S is clogged in the printer, for example, when the sheet S is bent, or is wrinkled.

The image quality inspection unit 52 according to the embodiment detects the above described abnormal formation of dots, and the abnormality of the transport system together by reading out an image which is formed on the sheet S. In this manner, the presence and absence of abnormality of an image which is formed on the sheet S is inspected.

Regarding Comparison Example

A comparison example will be described before describing the embodiment.

Figure 6:
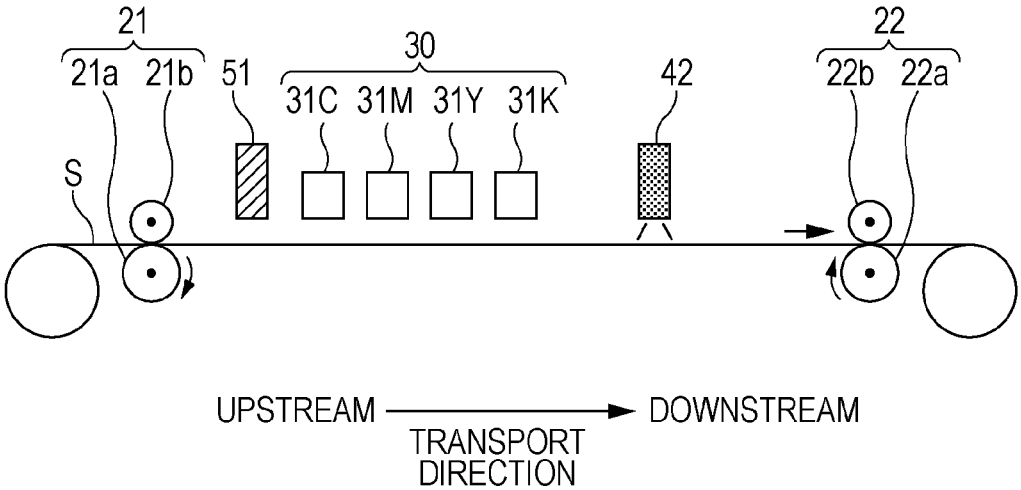
FIG. 6 is a schematic diagram which illustrates the periphery of a printing area in a comparison example.

FIG. 6 is a schematic diagram which illustrates the periphery of a printing area in the comparison example. In addition, portions having the same configuration as in FIG. 2 will be given with the same reference numerals, and descriptions thereof will be omitted. In the comparison example, a sensor 51 is provided on the upstream side of a head unit 30 in the transport direction. In addition, the sensor 51 determines an abnormality of a sheet S when being transported (that is, abnormality in transport system). The sensor 51 detects, for example, a position of the sheet S at end in the paper width direction, and in this manner, detects an abnormality in the transport system (skewing, paper jam, or the like).

A controller 60 in the comparison example stops printing when the sensor 51 detects an abnormality (skewing, paper jam, or the like). More specifically, the controller 60 stops ink ejecting from each head of the head unit 30, and irradiation of UV from an irradiation portion 42. In addition, stopping of irradiation of the UV is performed in order to prevent the sheet S from deteriorating, igniting, or the like, due to excessive irradiation.

In this case, dots which are formed on the sheet S which is located between the head unit 30 and the irradiation portion 42 are not performed with the UV irradiation. That is, the dots on this portion are printed in a state of not being cured. If an image which is formed in this range is non-abnormal (normal), the sheet S is useless. That is, waste paper occurs.

Therefore, according to the embodiment, it is possible to reduce the waste paper when an abnormality occurs.

Regarding Printing Process According to First Embodiment

As described above, the printer 1 according to the first embodiment includes the image quality inspection unit 52 between the head unit 30 and the irradiation portion 42. In other words, the image quality inspection unit 52 is provided on the downstream side of each head of the head unit 30 in the transport direction, and on the upstream side of the irradiation portion 42 in the transport direction. In addition, the image quality inspection unit 52 inspects an image quality of an image by reading out an image which is printed on the sheet S which is transported in the transport direction, and detects a formation abnormality of the image. In addition, as described above, the image quality inspection unit 52 inspects the formation abnormality (dot missing, or the like) of an image which is caused in each head, and the formation abnormality of an image due to the transport system (skewing, deviation of landing position due to paper jam, or the like) together.

The controller 60 controls the UV irradiation of the irradiation portion 42 according to a inspection result of the image quality inspector 52.

Figure 7:
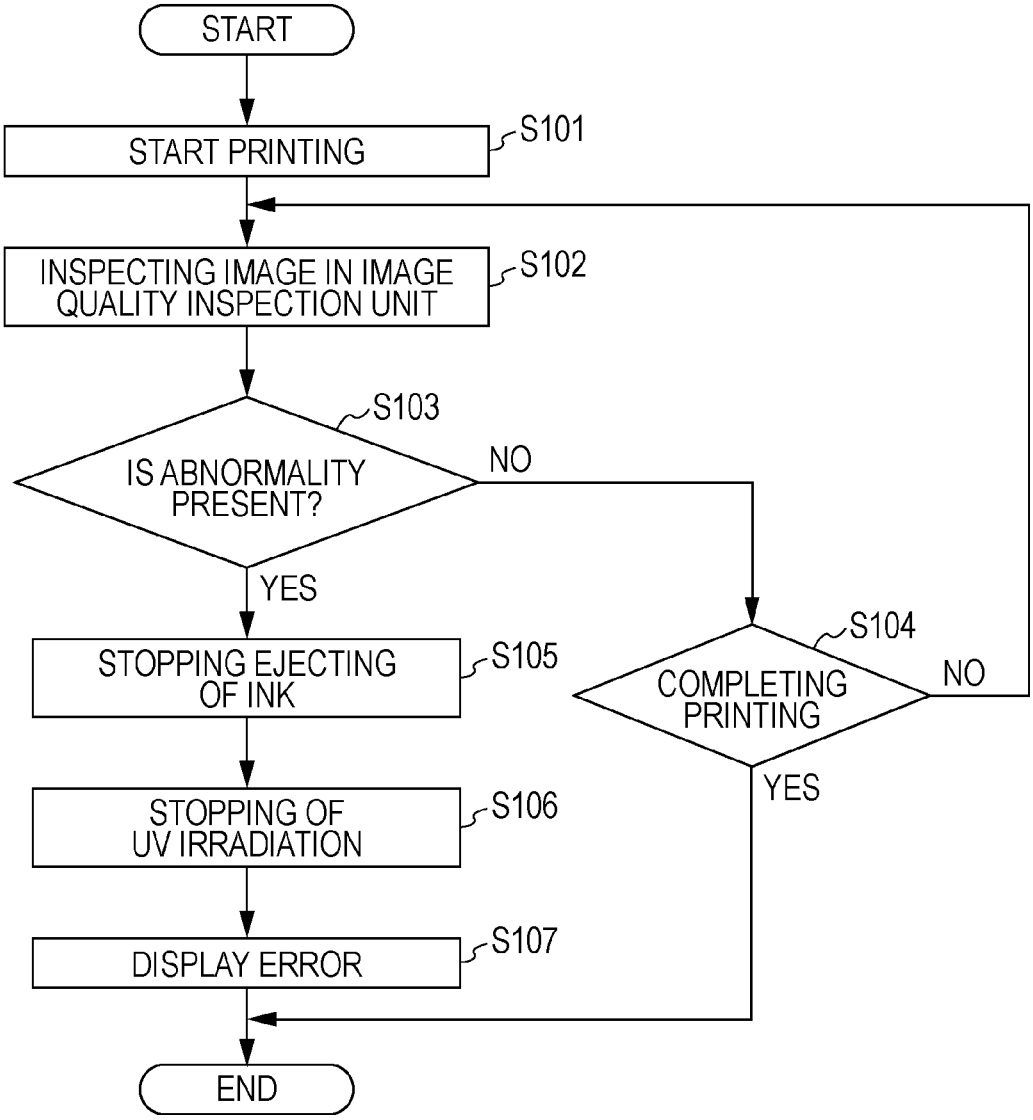
FIG. 7 is a flowchart which illustrates a processing order when performing printing according to a first embodiment.

FIG. 7 is a flowchart which describes a processing order in printing according to the first embodiment.

First, the sheet S is set in the printer 1, and then the controller 60 starts printing (S101). Specifically, the controller 60 causes each head of the head unit 30 to eject UV ink based on the print data while transporting the sheet S to the transport unit 20 in the transport direction, and causes the irradiation portion 42 to radiate the UV. In addition, at the time of printing, the controller 60 causes the image quality inspection unit 52 to inspect the image quality of an image which is formed on the sheet S which is being transported (S102). When there is no abnormality in the inspection result of the image quality inspection unit (NO in S103), it is determined whether or not completing of printing (S104). If it is not completing of printing (NO in S104), the process returns to step S102, and if it is determined to be completing of printing (YES in S104), the printing processing is completed.

On the other hand, when it is determined that there are abnormalities in the inspection result of the image quality inspection unit 52 in step S103 (YES in S103), the controller 60 stops the ejection of ink in each head (S105), and sets an input current to a light source (LED) of the irradiation portion 42 to zero. That is, the UV irradiation from the irradiation portion 42 is stopped (S106). Thereafter, for example, an error is displayed in a display unit (not shown) or the like of the computer 110.

According to the embodiment, abnormalities are detected by reading out an image on the downstream side of the head unit 30 in the transport direction, in contrast to the comparison example in which the abnormalities are detected on the upstream side of the head unit 30 in the transport direction. For this reason, if the UV irradiation from the irradiation portion 42 is stopped when the abnormalities are detected, the amount of images which are not irradiated with the UV (uncured images) in spite of being printed becomes small compared to the comparison example. That is, it is possible to reduce wasteful printed matter (waste paper).

As described above, the printer 1 according to the embodiment includes each head of the head unit 30 which ejects the UV ink which is cured by being irradiated with the UV onto the sheet S, the irradiation portion 42 which radiates UV to the UV ink which is landed onto the sheet S, and the image quality inspection unit 52 which inspects the image quality of an image which is formed on the sheet S. In addition, the controller 60 stops irradiation of UV of the image quality irradiation portion 42 when the image quality inspection unit 52 detects abnormal formation of the image. In this manner, it is possible to reduce the wasteful printed matter (waste paper).

Second Embodiment

A timing of stopping UV irradiation in a second embodiment is different from that in the first embodiment. In addition, since a configuration of a printer 1 is the same as that of the first embodiment, descriptions thereof will be omitted.

Figure 8:
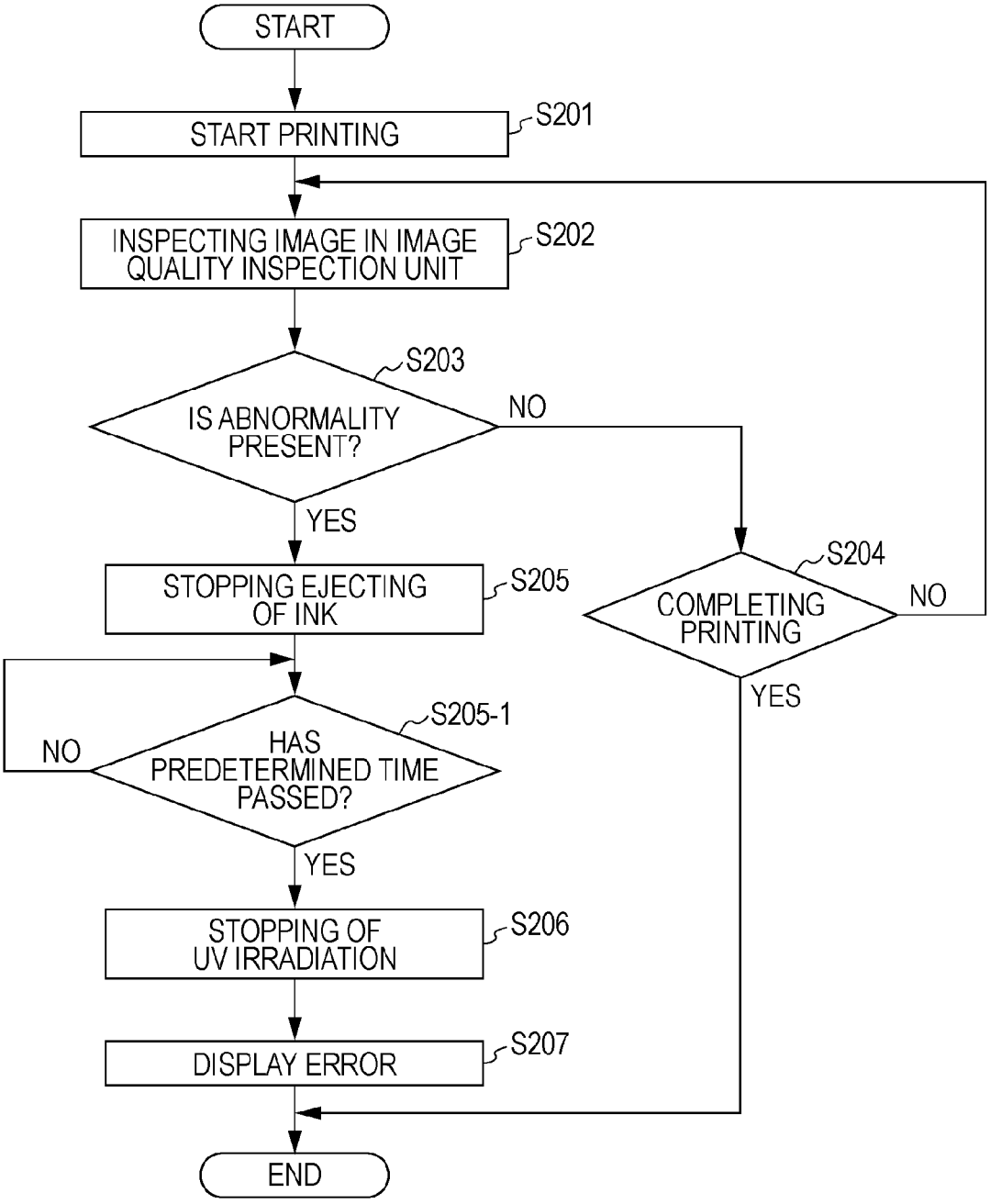
FIG. 8 is a flowchart which illustrates a processing order when performing printing according to a second embodiment.

FIG. 8 is a flowchart which describes a processing order in printing according to the second embodiment. In FIG. 8, steps S201 to S207 correspond to the steps S101 to S107 in FIG. 7 in the first embodiment, respectively.

In the second embodiment, a controller 60 stops the ejection of ink from each head (S205) when there are abnormalities in the image quality (YES in S203), and determines whether or not a predetermined time has passed (S205-1). In addition, the controller 60 stops UV irradiation of an irradiation portion 42 (S206) when it is determined that the above predetermined time has passed (YES in S205-1). In this manner, it is possible to further reduce images which are not irradiated with UV (uncured images) in spite of being printed compared to the first embodiment. That is, it is possible to further reduce waste paper.

In addition, the above predetermined time is arbitrarily determined based on a transport speed and transport path (distance) of the sheet S. For example, when the predetermined time is set to be larger than a value in which the distance between an image quality inspection unit 52 and the irradiation portion 42 is divided by the transport speed of the sheet S, it is possible to stop the UV irradiation of the irradiation portion 42 after the image quality inspection unit 52 detected abnormalities of an image, and then the image passed through the irradiation portion 42 (that is, after being irradiated with UV). In this case, it is possible to further reduce the waste paper. In addition, for example, it is also preferable that the UV irradiation of the irradiation portion 42 be stopped after physically confirming that the image which is formed, for example, using the head unit 30 has passed through the irradiation portion 42 using a sensor or the like, without being limited to this.

Third Embodiment

Regarding Configuration of Printer

The position of an image quality inspection unit 52 in a third embodiment is different from that in the above described embodiment.

Figure 9:
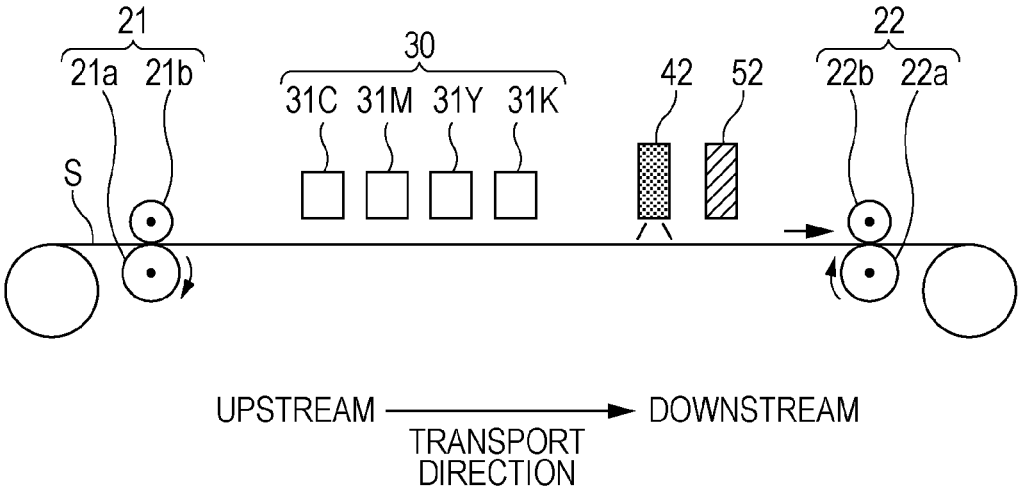
FIG. 9 is a schematic diagram which illustrates the periphery of a printing area in a third embodiment.

FIG. 9 is a schematic diagram which illustrates the periphery of a printing area according to the third embodiment. A position of the image quality inspection unit 52 in a third embodiment is different from that of the above described embodiment (FIG. 2). Specifically, according to the third embodiment, the image quality inspection unit 52 is provided on the downstream side of the irradiation portion 42 in the transport direction. In addition, the image quality inspection unit 52 in the third embodiment performs an inspection of an image quality including abnormalities due to the UV irradiation of the irradiation portion 42.

Regarding Abnormality due to UV Irradiation

UV ink includes a polymerization initiator of a yellow color which absorbs light of the wavelength of UV rays (purple to blue). For example, the yellow polymerization initiator is included in clear ink, as well, and the clear ink is close to light yellow, and not colorless and transparent, in practice. It is assumed that the clear ink cannot absorb light (UV ray) if the ink is completely transparent. Similarly, the polymerization initiator is also included in UV ink of other colors. That is, the color of each UV ink color includes the color of the polymerization initiator. When the UV is radiated to such UV ink, the polymerization initiator in the ink is disintegrated, a radical is generated, and a monomer becomes polymer when the radical attacks the monomer. At this time, the color (yellow) of the polymerization initiator disappears when the polymerization initiator is disintegrated.

However, when an energy of the UV irradiation is too high (for example, 500 mJ/cm$^2$ or more), the polymerization initiator of the UV ink is disintegrated while maintaining the color thereof (without achromatizing). For example, in the case of clear ink, there are cases where the light yellow color remains as is without becoming colorless and transparent after being irradiated with UV. There are cases where the color of the polymerization initiator remains without disappearing, similarly, even in other colors. In addition, there are cases where the color of the polymerization initiator remains without disappearing, similarly, when the energy of the UV irradiation is too low. In this manner, there are cases where the color of the polymerization initiator does not disappear due to an abnormality of the UV irradiation even when dots (image) which are formed on the sheet S pass under the irradiation portion 42. The image quality inspection unit 52 according to the third embodiment inspects the abnormal formation of an image including the abnormality due to the UV irradiation.

Regarding Processing at Time of Abnormal

The image quality inspection unit 52 according to the third embodiment is provided on the downstream side of the UV irradiation portion 42 in the transport direction. In addition, the image quality inspection unit 52 according to the third embodiment determines the presence or absence of the abnormal formation of an image by reading out the image which is irradiated with UV, and comparing the image to print data. That is, the image quality inspection unit 52 according to the third embodiment determines the presence or absence of the abnormal formation of an image including the abnormality of UV irradiation due to the UV irradiation portion 42. For example, when the color of the polymerization initiator is included in the reading result of the image quality inspection unit 52, it means that the UV is not normally irradiated (UV ink is not completely cured). When such an abnormality is detected, for example, as in the first embodiment, the controller 60 stops ejecting of ink from each head of the head unit 30, and stops the UV irradiation from the irradiation portion 42.

In this manner, in the third embodiment, it is possible to determine the presence or absence of abnormalities including the irradiation portion 42, by arranging the image quality inspection unit 52 on the downstream side of the irradiation portion 42 in the transport direction.

Other Embodiments

The printer or the like has been described as embodiments, however, the above described embodiments are for the purpose of facilitating the comprehension of the invention, and the invention is not construed by limiting to the embodiments. The invention may be changed and modified without departing from the scope of the invention, and it goes without saying that the equivalents thereof are included in the invention as a matter of course. In particular, the embodiments described below are included in the invention.

Regarding Printer

In the above described embodiments, the printer has been described as an example, however, the invention is not limited to this. For example, it is possible to apply the same technology as that of the embodiments can be applied to various devices to which the ink jet technology is applied, such as color filter manufacturing equipment, dyeing equipment, minute processing equipment, semiconductor producing equipment, surface processing equipment, three-dimensional molding machine, liquid carburetor system, organic EL production equipment (in particular, polymer EL producing equipment), display manufacturing equipment, film formation equipment, DNA chip production equipment.

In addition, the line printer has been described in the above described embodiments, however, it is not limited to this. For example, it may be a printer in which a plurality of heads are provided opposing to the peripheral surface of a cylindrical transport drum, and the irradiation portion is provided on the downstream side of the plurality of heads in the transport direction. In addition, it may be a printer in which an image is printed by alternately repeating a transport operation which transports a medium for printing in the transport direction, and a dot formation operation (pass) which forms dots on the medium for printing by intermittently ejecting ink while moving heads in the movement direction which intersects the transport direction (a so-called serial printer). Even in such a printer, it is preferable to provide the image quality inspection unit at the same position as that of the above described embodiments (for example, between the head and irradiation portion, or on the downstream side of the irradiation portion in transport direction), and determine the abnormal formation of an image.

Regarding Ink

In the above described embodiment, ink (UV ink) which is cured by being irradiated with ultraviolet light (UV) is ejected from nozzles. However, liquid which is ejected from the nozzles is not limited to the ink which is cured by UV light, and may be ink which is cured by visible light. In this case, visible light (light) having a wavelength in which ink is cured is radiated from the irradiation portion 42.

In addition, in the above described embodiments, as color inks, four color inks of cyan, magenta, yellow, and black have been used, however, ink of other colors than these (for example, light cyan, light magenta, green, orange, white, clear, or the like) may be used.

Regarding Processing of Computer 110

In the above described embodiment, the printer driver of the computer 110 has performed resolution conversion processing, color conversion processing, halftoning processing, thinning-out processing, or the like. However, a part, or all of these processing may be performed on the printer 1 side.

Regarding Control of Controller 60

In the above described embodiment, the controller 60 has stopped the UV irradiation from the irradiation portion 42 when the image quality inspection unit 52 detected the abnormal formation of an image, however, it is not limited to this, and a control may be performed such that an intensity of the UV irradiation from the irradiation portion 42 is reduced. Even in this case, it is possible to prevent the sheet S from deteriorating, or igniting due to excessive irradiation at the time of occurring of abnormality.

The entire disclosure of Japanese Patent Application No. 2011-250384, filed Nov. 16, 2011 is expressly incorporated by reference herein.

What is claimed is:

1. An image forming apparatus comprising:

an ejecting unit which ejects liquid cured by being irradiated with light onto a medium for printing;

an irradiation unit which irradiates the liquid which has landed onto the medium for printing with the light; and an image quality inspection unit which inspects image quality of an image which is formed on the medium for printing, wherein, when the image quality inspection unit detects abnormal formation of the image, an intensity of the light of the irradiation unit is controlled, wherein the ejecting unit and the irradiation unit are provided on a transport path of the medium for printing, and wherein the image quality inspection unit is arranged on a downstream side of the ejecting unit in a transport direction of the medium for printing, and on an upstream side of the irradiation unit in the transport direction.

2. The image forming apparatus according to claim 1, wherein the light intensity of the light of the irradiation unit is controlled after a predetermined time has passed after detecting the abnormal formation of the image by the image quality inspection unit.

3. The image forming apparatus according to claim 2, wherein the predetermined time is set based on a transport speed and a transport path of the medium for printing.

4. The image forming apparatus according to claim 2, wherein the intensity of the light of the irradiation unit is controlled after the image has passed through the irradiation unit after detecting the abnormal formation of the image by the image quality inspection unit.

5. The image forming apparatus according to claim 1, wherein the intensity of the light of the irradiation unit is weakened when the image quality inspection unit detects the abnormal formation of the image.

6. The image forming apparatus according to claim 1, wherein the irradiation of the light from the irradiation unit is stopped when the image quality inspection unit detects the abnormal formation of the image.

7. An image forming apparatus comprising:

an ejecting unit which ejects liquid cured by being irradiated with light onto a medium for printing;

an irradiation unit which irradiates the liquid which has landed onto the medium for printing with the light; and an image quality inspection unit which inspects image quality of an image which is formed on the medium for printing, wherein, when the image quality inspection unit detects abnormal formation of the image, an intensity of the light of the irradiation unit is controlled, wherein the light intensity of the light of the irradiation unit is controlled after a predetermined time has passed after detecting the abnormal formation of the image by the image quality inspection unit.

* * * * *